United States Patent [19]

Dennis

[11] Patent Number: 4,911,182

[45] Date of Patent: Mar. 27, 1990

[54] EXPANSION OF TOBACCO

[75] Inventor: Eric H. Dennis, Tonbridge, England

[73] Assignee: British-American Tobacco Company Limited, London, England

[21] Appl. No.: 198,076

[22] Filed: May 24, 1988

[30] Foreign Application Priority Data

May 28, 1987 [GB] United Kingdom ..... 8712618

[51] Int. Cl.[4] ..... A24B 3/18

[52] U.S. Cl. ..... 131/296; 131/109.1

[58] Field of Search ..... 131/296, 304, 109.1, 131/110; 55/320, 318

[56] References Cited

U.S. PATENT DOCUMENTS 4,459,999 7/1984 Brackmann et al. ..... 131/109.1

4,697,604 10/1987 Brown et al. ..... 131/304

*Primary Examiner*—V. Millin

*Attorney, Agent, or Firm*—Kane, Dalsimer, Sullivan, Kurucz, Levy, Eisele and Richard

[57] ABSTRACT

Extraction means capable of providing a constant feed rate to the inlet of a tobacco expansion pneumatic transport system is provided at the outlet of a tobacco reservoir zone. The extraction means is preferably in the form of a pinned roller capable of metering tobacco, associated with a pinned tobacco opening roller. The extraction means feeds the extracted tobacco into a transport duct as a stream extending across the full width of the duct at a flow rate which is also uniform across the width of the stream.

21 Claims, 3 Drawing Sheets

EXPANSION OF TOBACCO

BACKGROUND OF THE INVENTION

Field of the Invention

The invention the subject of the present application relates to the expansion of particulate tobacco.

In United Kingdom Patent Specification No. 2 176 385A there is disclosed tobacco expansion apparatus comprising a transport duct, gaseous supply means operable to supply hot gaseous medium to the duct at an upstream end thereof, feed means operable to feed particulate tobacco to the duct, and a tobacco/gaseous medium separator, the gaseous medium inlet of which separator is in gas flow communication with the downstream end of the duct. The tobacco/gaseous medium separator is of a type in the operation of which the tobacco particle residence time therein is exceptionally low. For this reason the overall residence time of tobacco particles in the expansion aparatus is low. The overall residence time may be, for example, less than two seconds, or even less than one second. It should be possible, because of the low overall tobacco particle residence time obtainable in the operation of the expansion apparatus of UK No. 2 176 385A to employ a high temperature gaseous medium without the tobacco particles being subjected to an over intensive heating regime. The temperature of the gaseous medium at entry to the transport duct may be, for example, at or above 250° C., more usually at or above 350° C.

A problem that can occur in the use of tobacco expansion apparatus such as that just mentioned is that, should the mass flow rate of the tobacco fall below the specified value therefore, there will be a tendency for tobacco particles to be unacceptably over heated. If, on the other hand, the mass flow rate of the tobacco is greater than that specified, insufficient heat will transfer to the tobacco particles for the particles to be expanded according to specification. The first of these problems is a function of the high heat content of the gaseous medium and the second arises from the short residence time characteristic of the apparatus.

It is an object of the subject invention to obviate the just mentioned problems in the expansion of tobacco in apparatus operable to bring the tobacco into contact, over a short contact time, with hot gaseous medium.

SUMMARY OF THE INVENTION

The subject invention provides tobacco expansion apparatus comprising a transport duct, gaseous supply means operable to supply hot gaseous medium to said duct at an upstream end thereof for flow therethrough, wall means bounding a tobacco reservoir zone, extraction means comprising tobacco engagement means, said extraction means being operable to extract particulate tobacco from said zone, and said extraction means being in tobacco flow communication with said upstream end of said duct, and tobacco/gaseous medium separation means, the gaseous medium inlet of said separation means being in gas flow communication with the downstream end of said duct.

DETAILED DESCRIPTION OF THE PREFERRED EMBODIMENTS OF THE INVENTION

Figure 1:
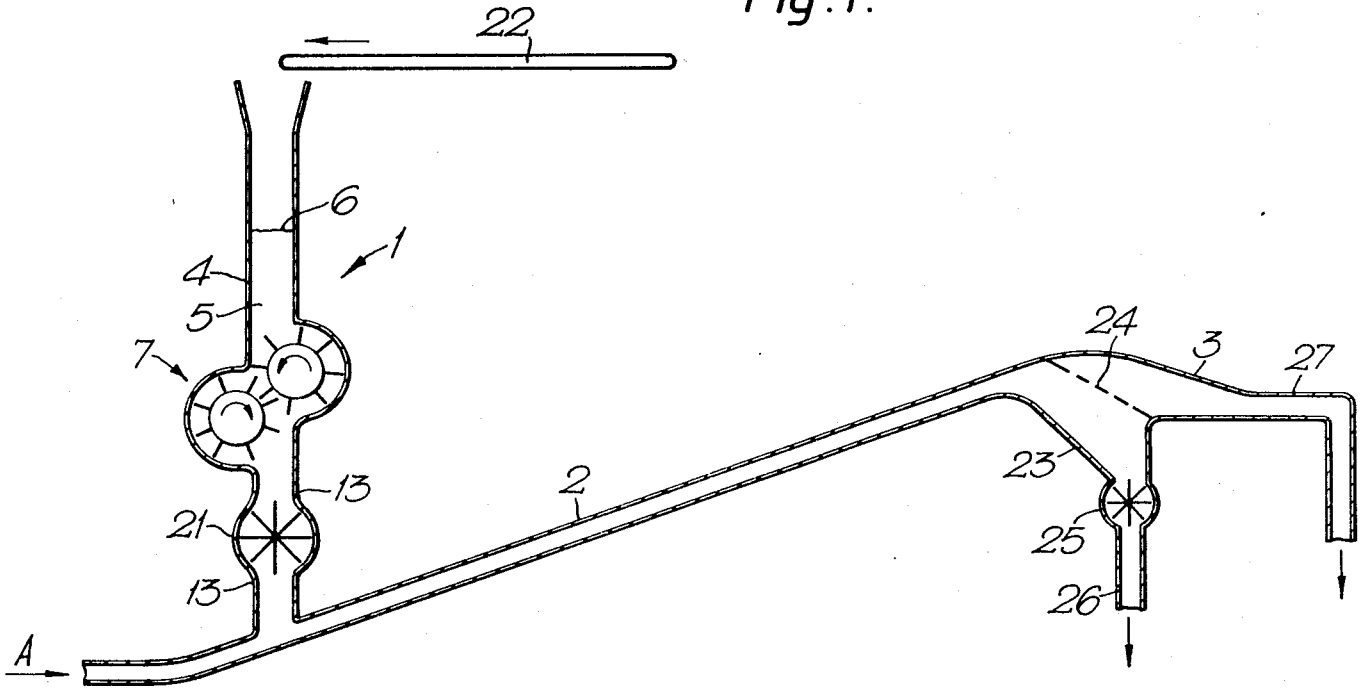
FIG. 1 shows parts, in elevation, of a tobacco expansion apparatus.

The extraction means should be operable to feed the extracted tobacco at a constant flow rate to the transport duct. The flow rate value adopted will be determined in accordance with the type of tobacco treated and the moisture content and particle size thereof, as well as with operating parameters such as the heat content of the gaseous medium, the flow rate of the gaseous medium and the contact time of the gaseous medium with the tobacco.

If, as is preferable, the transport duct is of rectangular section and the tobacco is fed into the duct at an upper, wider side of the duct, it is advantageous that the tobacco should be fed into the duct as a stream extending transversely of the duct and suitably extending across the full width, or at least a major proportion of the full width, of the duct. It is also preferable that the tobacco flow rate should be uniform across the width of the stream.

The extraction means preferably comprises cylinder means rotatively mounted at the tobacco outlet of the reservoir zone and drive means operable to rotate the cylinder means at a constant velocity. In order for the cylinder means to engage effectively tobacco particles and to draw the particles from the reservoir zone, the cylinder means comprises outwardly extending tobacco engagement means advantageously taking the form of pins or teeth, which engagement means suitably project radially outwardly, of the periphery of the cylinder means.

The tobacco engagement means of the cylinder means may be arranged to pass through a tobacco discharge passage during rotation of the cylinder means, which passage is bounded by the periphery of the cylinder means and by an extension of the wall means bounding the reservoir zone. Further tobacco engagement means may project from the wall means extension into interdigitation with tobacco engagement means of the cylinder means, thus to provide tobacco opening means. The opening means functions to disentangle any entangled elongate tobacco particles and to liberate any nonelongate particles agglomerated with elongate particles.

The extraction means may comprise as opening means a second cylinder means rotatively mounted, parallel to the first mentioned cylinder means, at a location downstream, with reference to the direction of tobacco flow from the reservoir zone, of the first mentioned cylinder means. The second cylinder means comprises outwardly projecting tobacco engagement means which interdigitate with tobacco engagement means of the first mentioned cylinder means. Drive means is provided for rotating the second cylinder means at a constant velocity, which velocity is significantly greater, by fifty times for example, than the velocity of the first mentioned cylinder means. The second cylinder means functions to pick the tobacco conveyed by the first mentioned cylinder means from the first mentioned cylinder means. Unopened tobacco will also be subjected to an opening action by the interaction of the second cylinder means with the first mentioned cylinder means.

As an alternative to a tobacco discharge passage being bounded by the periphery of a cylinder means and an extension of the wall means defining the reservoir zone, a tobacco discharge passage may be bounded by the respective peripheries of first and second cylinder means rotatively mounted, parallel one to the other at the same height location, at the tobacco outlet of the reservoir zone. Extraction means according to this alternative arrangement comprises drive means operable to drive the two cylinder means at the same constant velocity, but in opposite directions, the directions being such that tobacco passes from the reservoir zone between the two cylinder means. Advantageously, each of the two cylinder means comprises tobacco engagement means which project outwardly, suitably radially outwardly, of the periphery of the cylinder means. Suitably, tobacco engagement means of the first cylinder means interdigitate with tobacco engagement means of the second cylinder means. Extraction means according to this alternative arrangement may further comprise a third cylinder means rotatively mounted, parallel to and equi-distant from the first and second cylinder means, at a location downstream, with reference to the direction of tobacco flow from the reservoir zone, of the common location of the first and second cylinder means. The third cylinder means comprises outwardly projecting tobacco engagement means which interdigitate with tobacco engagement means of the first and second cylinder means. Drive means is provided for rotating the third cylinder means at a constant velocity, which velocity is significantly greater than the velocity of the first and second cylinder means.

The tobacco reservoir zone is preferably located over the upstream end of the transport duct. Suitably, the tobacco reservoir zone is of an upright, elongate configuration.

Tobacco expansion apparatus according to the subject invention may comprise an airlock, advantageously a rotary airlock, through which, in operation of the apparatus, tobacco may be fed in the passage thereof from the extraction means to the transport duct. Less preferably, such an airlock may be located for the feed therethrough of tobacco to the reservoir zone.

The subject invention further provides a method of expanding tobacco, wherein a flow of hot gaseous medium is established in a transport duct, particulate tobacco is fed to a reservoir zone, extraction means comprising tobacco engagement means is activated to extract tobacco from said zone and to feed the extracted tobacco into said duct at a constant flow rate, and at the downstream end of said duct the tobacco is separated from the gaseous medium.

The tobacco may be stem which has been shredded in accordance with a method disclosed in U.S. Pat. No. 3,204,641 and United Kingdom Patent Specification No. 2 078 085. Cut lamina tobacco is among the other forms of tobacco expandable by use of the present invention.

The gaseous medium may be, for example, steam, air, steam and air, or nitrogen.

By use of the present invention tobacco may be subjected to gaseous medium temperatures at, or far in excess of, 350° C. with the assurance that the tobacco will be expanded according to specification without being over or under heated.

In order that the subject invention may be clearly understood and readily carried into effect, reference will now be made, by way of example, to the diagrammatic drawings hereof, of FIGS. 1–3:

FIG. 1 shows parts, in elevation, of a tobacco expansion apparatus; and

Figure 2:
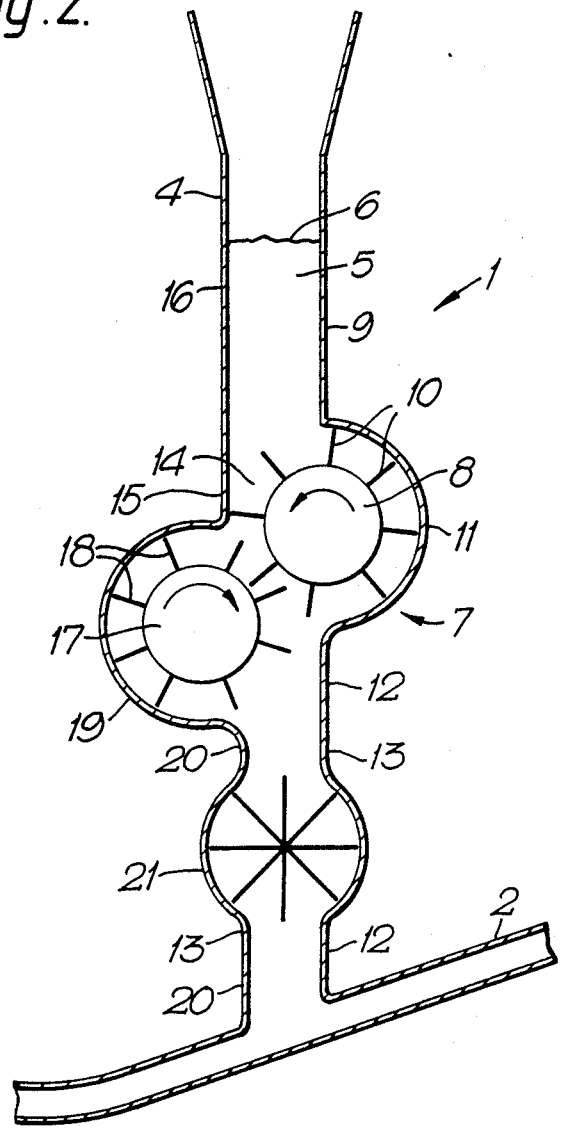
FIG. 2 shows, to a larger scale, feed means of the apparatus of FIG. 1.

FIG. 2 shows, to a larger scale, feed means of the apparatus of FIG. 1.

The tobacco expansion apparatus shown in the drawings comprises tobacco feed means generally designated by reference numeral 1, an upwardly inclined transport duct 2 and a tobacco/gaseous medium separator 3. Arrow A indicates the direction of flow of hot gaseous medium, a steam and air mixture for example, from supply means (not shown) to the upstream end of the transport duct 2.

The tobacco feed means 1 comprises an upright, elongate container 4 which provides a tobacco reservoir zone 5. In plan view the container 4 is of rectangular configuration, a lesser dimension side of the container 4 being viewed in the drawings. Reference numeral 6 designates the upper surface of a body of particulate tobacco, shredded stem tobacco for example, in the reservoir zone 5.

Extraction means of the feed means 1 is designated by reference numeral 7. The extraction means 7 comprises a first horizontally disposed and rotatively mounted cylindrical roller 8. Roller 8 is located at the lower, outlet end of the reservoir zone 5 and the axis of roller 8 is in the plane of a wall 9 of the container 4. The operative lengthwise dimension of the roller 8 is co-terminous with the width, i.e. longer dimension, of the container 4.

Tobacco engaging pins 10 project radially from the peripheral surface of the roller 8. The pins 10 are arranged in groups equi-spaced along the length of the roller 8, the pins of any one group being disposed in a common transverse plane of the roller 8 and being equi-angularly spaced about the peripheral surface of the roller 8. As viewing the peripheral surface of the roller 8, the pins 10 are arranged in a plurality of helices.

A curved wall 11, the centre of curvature of which is the axis of the roller 8, extends from the lower end of the wall 9 to a wall 12 of a rectangular cross-section chute 13, which chute 13, at the lower end thereof, opens into the transport duct 2. The width of the chute 13 is the same as the width of the container 4.

Drive means (not shown) is operable to rotate the roller 8, in the direction indicated by the arrow thereon, at a constant selected velocity. As the roller 8 is rotated, the pins 10 pass through a tobacco discharge passage 14 bounded by the peripheral surface of the roller 8 and by a downward extension 15 of a wall 16 of the container 4.

The extraction means 7 further comprises a second roller 17, which roller 17 is, in construction and dimensions, similar to the roller 8. The roller 17 is rotatively mounted parallel to the roller 8, but at a location downstream of the roller 8, i.e. lower than the roller 8. The roller 17 comprises tobacco engaging pins 18 which project radially from the peripheral surface of the roller 17 and are arranged in groups equi-spaced along the length of the roller 17. The groups of pins 18 of the roller 17 are offset with respect to the groups of pins 10 of the roller 8, the arrangement being that the pins 10 and 18 interdigitate.

Drive means (not shown) is operable to rotate the roller 17, in the direction indicated by the arrow thereon, at a constant selected velocity significantly greater than the velocity at which the roller 8 is rotated.

A curved wall 19, the centre of curvature of which is the axis of the roller 17, extends from the lower end of the extension 15 of the wall 16 of the container 4 to a wall 20 of the chute 13.

Mounted in the chute 13 is a rotary airlock 21.

A belt conveyor 22 is operable to feed tobacco to the reservoir zone 5.

The separator 3, which is generally of the type described in the aforesaid Specification No. 2 176 385A, comprises a casing 23, extending across the interior of which is a downwardly inclined separation screen 24. At the lowermost location of the separator 3 a rotary airlock 25 communicates with a downwardly extending tobacco discharge pipe 26. The transport duct 2 opens into the casing 23 at an upper location to the same side of the screen 24 as is the airlock 25. At the other side of the screen 24 there extends from the casing 23 a gaseous medium outlet duct 27.

In operation of the apparatus to expand particulate tobacco, shredded stem tobacco for example, a flow of a steam/air mixture is established in the transport duct 2 in the direction of arrow A. Tobacco is fed to the reservoir zone 5 from the conveyor 22 to provide a body of tobacco in the zone 5. Tobacco is continuously extracted from the zone 5 by the rotating roller 8, the tobacco being drawn through the tobacco discharge passage 14 before being removed from contact with the pins 10 of the roller 8 by the faster moving pins 18 of the roller 17. The roller 17 acts to direct the tobacco down the chute 13, through which the tobacco falls as a stream extending transversely across the full width of the airlock 21, driven by rotary means (not shown), and from thence as a stream extending across the full width of the rectangular cross-section transport duct 2. As the tobacco particles enter the transport duct 2 they are entrained in the flow of the steam/air mixture and are transported along the duct 2 to the separator 3, the screen 24 of which permits passage therethrough of the steam/air mixture to the outlet duct 27 but constrains the tobacco particles to pass downwardly to the airlock 25, driven by rotary drive means (not shown). The tobacco particles pass from the airlock 25 through the discharge pipe 26 to a receptacle or conveyor (not shown).

In order to promote the ready entrainment of the tobacco particles in the steam/air mixture, the interior of the transport duct may at the upstream end thereof be of venturi form, with the chute 13 opening at the throat of the venturi.

Notwithstanding the high temperature of the steam/air mixture, which may be 350° C. or more, and the short residence time of the particles in contact with the mixture, two seconds or less, the uniformity of the tobacco feed provided by the feed means 1 ensures that none of the tobacco particles is subjected to too much or too little heat transfer.

Figure 3:
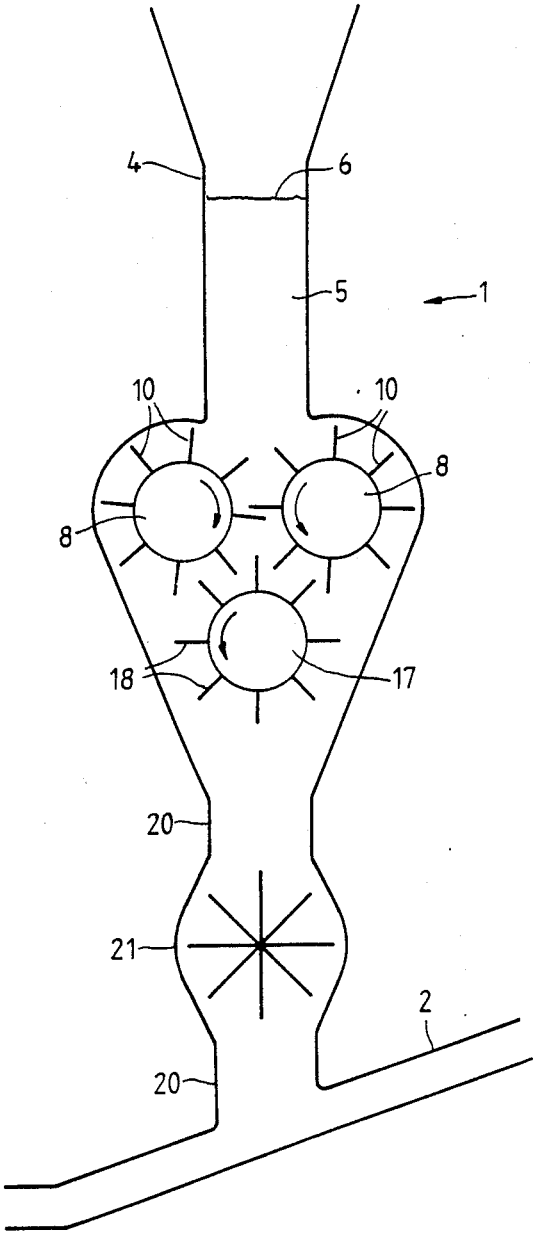
FIG. 3 is a view as in FIG. 2, of alternate embodiment apparatus of FIG. 1.

Referring now to FIG. 3, an alternate embodiment extraction means will be described. Components which are similar or functionally equivalent are numbered as in FIG. 2.

In an extraction means a variant of the extraction means 7, two rollers, are located at the same level. Roller 17 is at at a somewhat lower level than the rollers 8. With such variant arrangement a tobacco discharge passage is bounded by the periphery of each of the rollers. The third toothed roller 17 may be located beneath and equidistant from the two rollers 8 at the common level for the purpose of removing tobacco from the discharge passage an opening the tobacco.

In the embodiment of FIG. 3, the two rollers 8 are each rotatively mounted parallel one to the other at the same height location, at the tobacco outlet of the tobacco reservoir 5 zone. Drive means (not shown in FIG. 3) may be operable to drive the two rollers 8 at the same constant velocity, but in opposite directions as shown by the arrows on rollers 8 in the FIG. 3. as previously described, the pins 10 on the rollers 8 comprise tobacco engagement means projecting outwardly of the respective rollers 8. The pins 10 of one roller 8 may be positioned to interdigitate with the pins 10 of the other roller 8. As also shown in the FIG. 3, the extraction means may further comprise the third roller 17, which has outwardly extending tobacco engagement pins 17 which interdigitate with pins 10 of rollers 8. The roller 17 is rotatively mounted parallel to and equidistant from each of the rollers 8 at a location downstream with reference to the direction of tobacco flow, of rollers 8. Drive means (not shown in FIG. 3) may be used to drive roller 3 at a constant velocity, greater than the velocity of rollers 8.

What is claimed is:

1. Tobacco expansion apparatus comprising a transport duct, gaseous supply means operable to supply hot gaseous medium to said duct at an upstream end thereof for flow therethrough, wall means bounding a tobacco reservoir zone, extraction means comprising tobacco engagement means projecting directly into said reservoir zone, said extraction means being operable to extract particulate tobacco from said zone and said extraction means being in tobacco flow communication with said upstream end of said duct, and tobacco/gaseous medium separation means, the gaseous medium inlet of said separation means being in gas flow communication with the downstream end of said duct.

2. Apparatus according to claim 1, wherein said extraction means comprises cylinder means rotatively mounted at a tobacco outlet of said tobacco reservoir zone and having said tobacco engagement means extending outwardly thereof, and drive means operable to rotate said cylinder means.

3. Apparatus according to claim 2, wherein said drive means is operable to rotate said cylinder means at a constant velocity.

4. Apparatus according to claim 2, wherein said extraction means comprises a tobacco discharge passage.

5. Apparatus according to claim 4, wherein said passage is bounded by a periphery of said cylinder means and by an extension of said wall means.

6. Apparatus according to claim 1, wherein said extraction means further comprises tobacco opening means.

7. Apparatus according to claim 6 which further comprises an extension of said wall means and wherein said opening means comprises further tobacco engagement means projecting from said extension of said wall means.

8. Apparatus according to claim 6, wherein said opening means comprises a second cylinder means rotatively mounted, parallel to the first mentioned cylinder means, at a location downstream, with reference to the direction of tobacco flow from said reservoir zone, of said first mentioned cylinder means.

9. Apparatus according to claim 8, wherein said second cylinder means comprises outwardly extending tobacco engagement means which interdigitate with said engagement means of said first mentioned cylinder means.

10. Apparatus according to claim 8, wherein drive means is operable to rotate said second cylinder means at a constant velocity, which velocity is significantly greater than said velocity of said first mentioned cylinder means.

11. Apparatus according to claim 4 wherein the extraction means further comprises a second cylinder means rotatively mounted at a tobacco outlet of said tobacco reservoir zone and having tobacco engagement means extending outwardly thereof, and drive means operable to rotate said second cylinder means; and wherein said tobacco discharge passage is bounded by respective peripheries of said cylinder means and second cylinder means, which two cylinder means are rotatively mounted, parallel one to the other at the same height location, at the tobacco outlet of said tobacco reservoir zone.

12. Apparatus according to claim 11, wherein drive means operable to drive said two cylinder means at the same constant velocity, but in opposite directions, is provided.

13. Apparatus according to claim 11, wherein each of said two cylinder means comprises tobacco engagement means which project outwardly of the respective cylinder means.

14. Apparatus according to claim 13, wherein the engagement means of said first mentioned cylinder means interdigitate with the engagement means of said second cylinder means.

15. Apparatus according to claim 11, wherein said extraction means further comprises third cylinder means, said third cylinder means comprising outwardly extending tobacco engagement means which interdigitate with the tobacco engagement means of said first mentioned cylinder means and said second cylinder means, and being rotatively mounted, parallel to and equi-distant from the first mentioned cylinder means and said second cylinder means, at a location downstream, with reference to the direction of tobacco flow, of the common location of the first mentioned cylinder means and said second cylinder means.

16. Apparatus according to claim 15 as appended to claim 12, wherein drive means is operable to rotate said third cylinder means at a constant velocity, which velocity is significantly greater than said velocity of said two cylinder means.

17. Apparatus according to claim 1, wherein an airlock is provided intermediate said extraction means and said transport duct, for the passage of tobacco therethrough.

18. A method of expanding tobacco, wherein a flow of hot gaseous medium is established in a transport duct, particulate tobacco is fed to a reservoir zone, extraction means comprising tobacco engagement means projecting directly into said reservoir zone, is activated to extract tobacco by drawing the tobacco from said zone and to feed the extracted tobacco into said duct at a constant flow rate, and at the downstream end of said duct the tobacco is separated from the gaseous medium.

19. Tobacco expansion apparatus, which comprises;

a transport duct having an upstream end and a downstream end;

gaseous supply means operable to supply hot gaseous medium to said duct at the upstream end for flow through said duct;

wall means bounding a tobacco reservoir zone;

extraction means, which comprises;

(i) tobacco engagement means which comprises a rotatively mounted first cylinder means at a tobacco outlet of the reservoir zone;

(ii) tobacco opening means, which comprises a second cylinder means rotatively mounted, parallel to the first cylinder means, at a location downstream, with reference to the direction of tobacco flow from said reservoir zone, of said first cylinder means; and (iii) drive means operable to rotate said second cylinder means at a constant velocity, which velocity is significantly greater than the velocity of said first cylinder means;

said extraction means being operable to extract particulate tobacco from said zone and said extraction means being in tobacco flow communication with said upstream end of said duct; and tobacco/gaseous medium separation means, the gaseous medium inlet of said separation means being in gas flow communication with the downstream end of said duct.

20. Tobacco expansion apparatus, which comprises;

a transport duct having an upstream end and a downstream end;

gaseous supply means operable to supply hot gaseous medium to said duct at the upstream end for flow through said duct;

wall means bounding a tobacco reservoir zone; extraction means, which comprises;

(i) tobacco engagement means which comprises first cylinder means rotatively mounted at a tobacco outlet of said tobacco reservoir zone and having said tobacco engagement means extending outwardly thereof; and a second cylinder means rotatively mounted at a tobacco outlet of said reservoir zone and having tobacco engagement means extending outwardly thereof, said first and second cylinder means being mounted parallel to one to the other at the same height location;

(ii) a tobacco discharge passage;

(iii) drive means operable to drive said first and second cylinder means at the same constant velocity, but in opposite directions;

(iv) third cylinder means, said third cylinder means comprising outwardly extending tobacco engagement means which interdigitate with the tobacco engagement means of the first cylinder means and the second cylinder means, and being rotatively mounted, parallel to and equi-distant from the first cylinder means and the second cylinder means, at a location downstream, with reference to the direction of tobacco flow, of the common location of the first cylinder means and the second cylinder means; and (v) drive means operable to rotate the third cylinder means at a constant velocity, which velocity is significantly greater than the velocity of the first and second cylinder means;

said extraction means being operable to extract particulate tobacco from said zone and said extraction means being in tobacco flow communication with said upstream end of said duct; and (vi) tobacco/gaseous medium separation means, the gaseous medium inlet of said separation means being in gas flow communication with the downstream end of said duct.

21. Tobacco expansion apparatus, which comprises;

a transport duct, having an upstream end and a downstream end;

gaseous supply means operable to supply hot gaseous medium to the duct at the upstream end for flow through the duct;

wall means bounding a tobacco reservoir zone;

extracting means, which comprises (i) cylinder means rotatively mounted at a tobacco outlet of said zone extending outwardly thereof and projecting directly into said reservoir zone (ii) drive means operable to rotate said cylinder means;

said extraction means being operable to extract particulate tobacco from said zone;

said extraction means being in tobacco flow communication with the upstream end of said duct; and tobacco/gaseous medium separation means in gas flow communication with the downstream end of said duct.

* * * * *